United States Patent [19]

Worner

[11] Patent Number: 4,669,347

[45] Date of Patent: Jun. 2, 1987

[54] DEVICE FOR CUTTING THROUGH ONE OR SEVERAL SHEETS LOCATED WHOLLY OR PARTIALLY ON TOP OF ONE ANOTHER

[75] Inventor: Kurt Worner, Backnang, Fed. Rep. of Germany

[73] Assignee: Maschinenbau Oppenweiler Binder GmbH & Co., Fed. Rep. of Germany

[21] Appl. No.: 815,861

[22] Filed: Jan. 2, 1986

[30] Foreign Application Priority Data

Jan. 10, 1985 [DE] Fed. Rep. of Germany ..... 3500632

[51] Int. Cl.[4] ..... B26D 1/24

[52] U.S. Cl. ..... 83/422; 83/435.2; 83/425; 83/500

[58] Field of Search ..... 83/422, 435.2, 500, 83/425

[56] References Cited

U.S. PATENT DOCUMENTS 4,046,043 9/1977 Kistner et al. ..... 83/435.2 X 4,569,265 2/1986 Kawashima et al. ..... 83/435.2 X

FOREIGN PATENT DOCUMENTS 3022772 1/1982 Fed. Rep. of Germany ..... 83/422

*Primary Examiner*—Donald R. Schran

*Attorney, Agent, or Firm*—John F. A. Earley; John F. A. Earley, III

[57] ABSTRACT

In order to cut through one or several sheets located wholly or partially on top of one another and guided, held by two transport conveyors, through a cutting zone in which a rotating cutting knife is arranged, of which the cutting edge is coordinated with the edge of one face of a cutting roller on the circumferential surface of which one transport conveyor is guided, with firm pressure and in order to achieve a precise cut, a pressure roller is provided, coordinated with the second transport conveyor and pressing it against the first transport conveyor, in the circumferential surface of which pressure roller an indentation has been made to accommodate the second transport conveyor and which extends axially, without contact, to the cutting plane of the cutting knife.

7 Claims, 3 Drawing Figures

Figure 1:
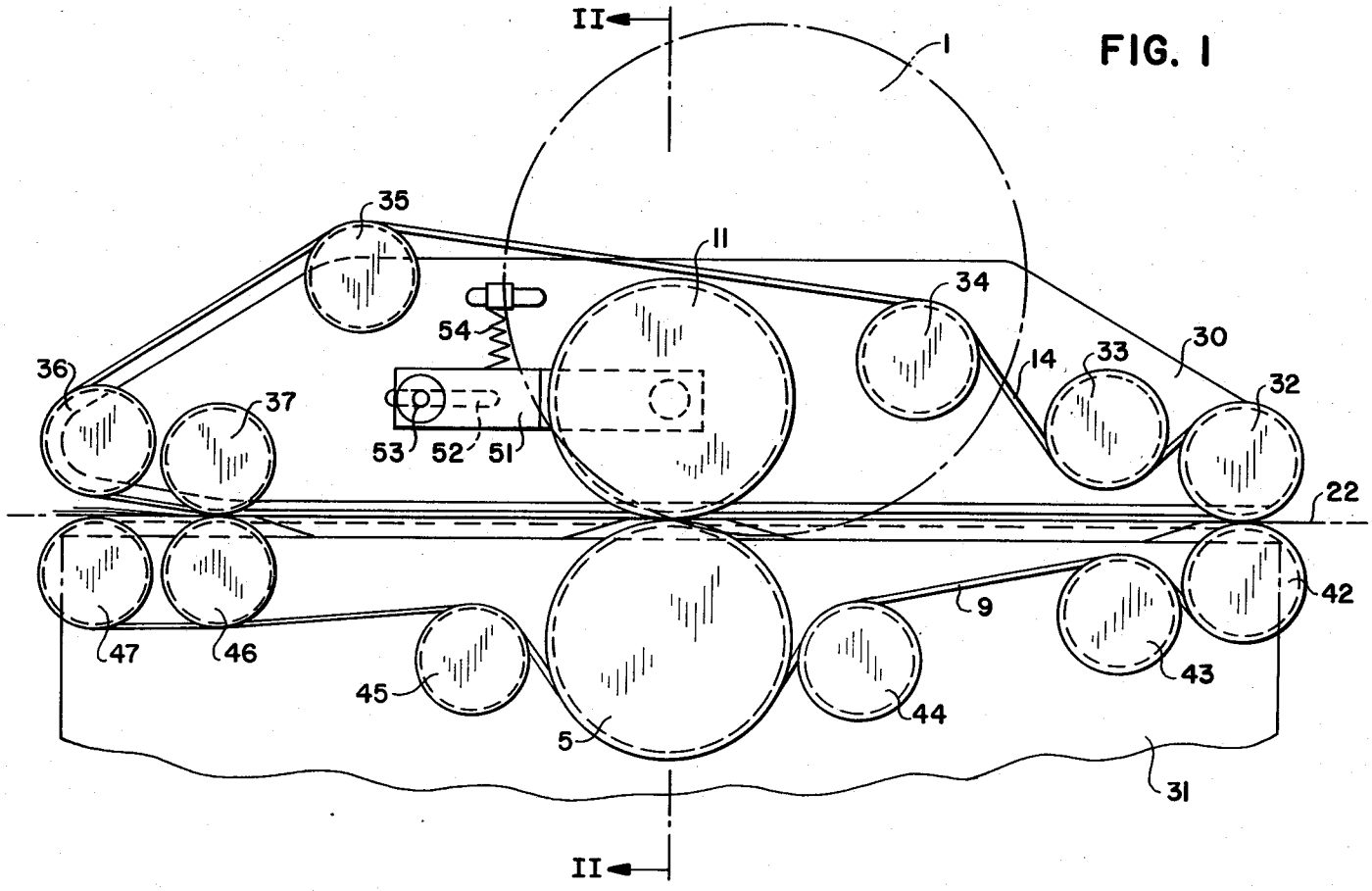

DEVICE FOR CUTTING THROUGH ONE OR SEVERAL SHEETS LOCATED WHOLLY OR PARTIALLY ON TOP OF ONE ANOTHER

The invention concerns a device for cutting through one or several sheets located wholly or partially on top of one another which, held between two transport conveyors, are brought through a cutting zone, in which a rotating cutting knife is arranged, the cutting edge of which is coordinated with the cutting line of one face of a cutting roller, on the circumferential surface of which one of the transport conveyors is guided, and in which is provided a device coordinated with the second transport conveyor, pressing it against the first transport conveyor.

In such a device, known from DT-OS No. 25 14 837, the transport conveyors and the sheets located between them are supported by support rollers prestressed against the one transport conveyor and are guided over a guide roller arranged below the circular knife in such a manner that they loop around a predetermined angular area of this guide roller. Thereby, the upper, squeezing transport conveyor extends beyond the lower transport conveyor in the direction of the circular knife. This means that the pressure between the transport conveyors in the cutting zone is not sufficiently strong, so that under the influence of the cutting forces, a dislocation of the material to be cut is possible, which impairs the exactness of the cut. Thereby that the transport conveyors with the material to be cut between them are brought into the cutting zone obliquely from below and are brought out of it obliquely downwards, the material to be cut may fan out, which also has a disadvantageous effect on the quality of the cut.

The purpose of the invention is thus to develop the device of the nature initially mentioned in such a manner that the sheets continuously fed in one plane through the cutting zone are held in place under firm pressure, perpendicularly to the transport direction, until immediately adjacent to the cutting level.

According to the invention, the problem is solved thereby that the device pressing one transport conveyor against the other consists of a pressure roller, in the circumferential surface of which an indentation has been made, for purposes of accommodating the other transport conveyor, and extends axially, without contact, to the cutting level of the cutting knife.

The device according to the invention has the advantage that the method of transporting the material to be cut, namely single sheets, stacks of sheets in the form of booklets or streams, in one plane, excludes the possibility of a deformation in the cutting zone, which would have a disadvantageous effect on the quality of the cut. By utilizing the pressure roller, a high level of pressure can be achieved up to the immediate vicinity of the cutting level, so that the desired precision of the cut is guaranteed.

Due to the fact that the pressure roller with adjustable pressure force, which can move in bearings, is prestressed against the cutting roller by means of a spring, it is possible to maintain the contact pressure even when the material to be cut is stepped, i.e. when its thickness varies, which may be the case e.g. when booklets are overlapping like scales.

The desired coordination between pressure roller and cutting zone can be achieved by means of the provided horizontal adjustment of the axle bearings of the pressure roller.

The fact that elevations and depressions, extending in the circumferential direction, are provided on the circumferential surface of the pressure roller and, extending in the longitudinal direction, on that surface of the transport conveyor which faces the pressure roller, guarantees a close-fitting guidance of the transport conveyor against the pressure roller, and due to the fact that the pressure remains almost to the cutting plane, the result is an outstanding quality of the cut, since the material to be cut is prevented from moving sideways and from fanning out on the cutting level.

Figure 2:
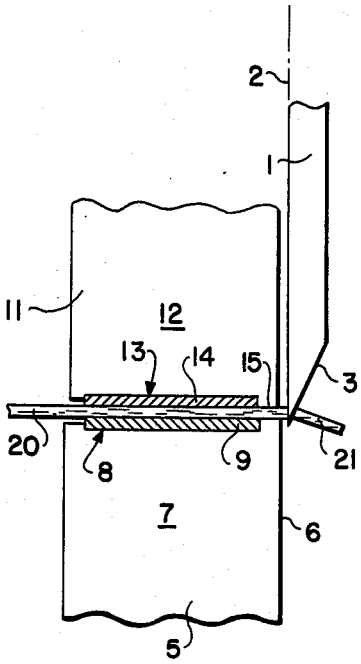

Execution examples of the invention are explained in greater detail with reference to drawings. The following is shown:

FIG. 1 a schematic side view of one execution of the device,

FIG. 2 the cutting zone of FIG. 1 in section II—II, and

Figure 3:
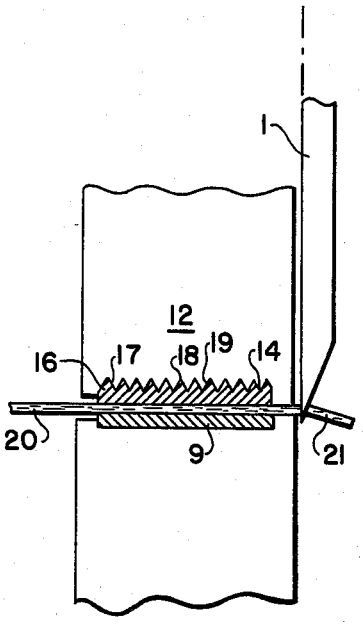

FIG. 3 the cutting zone with a modified guidance of the transport conveyor against the pressure roller, in a view as in FIG. 2.

The device shown in FIGS. 1 through 3 consists of an upper, belt-shaped transport conveyor 14, which runs in an endless loop over guide and tension rollers 33, 34, 35, 36, and 37, whereby the belt runs straight between the rollers 37 and 32. The rollers 32, 33, 34, 35, 36, and 37 rest in bearings in an upper load-carrying frame 30.

A belt-shaped, lower transport conveyor 9 runs in an endless loop over guide and tensions rollers 43, 44, 45, 46, and 47, in such a manner that between the rollers 46 and 42, it runs on a straight line and parallel to the upper straight part of the transport conveyor 14. Between the guide rollers 44 and 45, a lower cutting roller is arranged, having on its circumferential surface 7 an indentation 8, in which the transport conveyor 9 runs and turns the cutting roller by engaging with the cutting roller 5 over a predetermined looped-around angle.

Located across from the cutting roller 5, there is a press roller 11, having in its circumferential surface 12 an indentation 13, in which the transport conveyor 14 is guided. Pressure roller 11 extends beyond the transport conveyor 14 in the direction of the cutting plane and thereby forms a pressure surface 15 which, in the cutting zone, abuts the pressure surface of the transport conveyor 14.

The pressure roller 11 rests in bearings in a supporting lever having an oblong hole 52 which is generally parallel to the transport plane 22, indicated by means of a dot-dash line. In the oblong hole 52 there is a link pin 53, the position of which in relation to the oblong hole 52 can be adjusted. The supporting lever 51 can be pivoted around the link pin 53 and is prestressed in the direction of the cutting roller 5 by means of a pressure spring 54, supported on the upper load-carrying frame 30.

The transport conveyor is driven by rollers 32 and 42. Rollers 42, 43, 44, 45, 46, and 47 together with cutting roller 5 are rotatable and rest in bearings in a lower load-carrying frame 31.

A rotatable cutting knife 1, of which the rotational axis is parallel to the rotational axis of the pressure roller 11 and of the cutting roller 5, has an oblique cutting edge 3 which ends in the cutting plane 2 of the cutting knife 1. As shown in FIG. 2, the cutting edge 6 of the cutting roller 5 cofunctions with the cutting knife 1.

A material 20 to be cut, which is guided between the upper transport conveyor 14 and the lower transport conveyor 9, runs through the cutting zone between the pressure roller 11 and the cutting roller 5 and is thereby firmly pressed against the cutting roller 5 by the pressure surface 15 in the cutting zone, whereby this pressure is brought very close to the cutting plane 2, allowing a straight and precise cut and forming a cut-off portion 21.

In order to guarantee precision guidance of the upper transport conveyor 14 along the circumferential surface 12 of the pressure roller 11, depressions 18 and elevations 19 are formed in the bottom of the indentation 13, which engage in the elevations 16 and depressions 17 on that side of the upper transport conveyor 14 which faces the pressure roller 11.

I claim:

1. A device for cutting through one or several sheets located wholly or partially on top of one another, comprising a frame, a first conveyor mounted on the frame, the first conveyor having an outer surface, a second conveyor mounted on the frame, the second conveyor having an outer surface, a conveying zone being formed between and defined by the outer surfaces of the first and second conveyors for clamping and for conveying the sheets to and through a cutting zone, a cutting roller having a side face and a circumferential surface on which the second conveyor is guided through the cutting zone, a rotating cutting knife having a cutting edge, the cutting edge of the knife being coordinated with a plane parallel to the cutting roller side face, means for rotating the cutting knife, means for driving the first conveyor, means for driving the second conveyor, a pressure roller having a circumferential surface and an indentation in the circumferential surface for accommodating the first conveyor, and the pressure roller being aligned with the cutting roller for pressing the first conveyor towards the second conveyor in the cutting zone, the pressure roller extending axially towards the plane of the cutting knife.

2. The device of claim 1, the pressure roller being movable on bearings, and further including spring means for preloading the pressure roller with an adjustable pressure force to bias the pressure roller towards the cutting roller.

3. The device of claim 2, the axle bearings of the pressure roller being horizontally adjustable.

4. The device of claims 1, 2, or 3, the pressure roller having elevations and depressions extending in the circumferential direction on the circumferential surface of the pressure roller, and the first conveyor having depressions and elevations in its outer surface extending in the longitudinal direction of the first conveyor that meet with the elevations and depressions in the pressure roller.

5. The device of claim 1, the cutting roller having an indentation in its circumferential surface of accommodating the second conveyor, and the cutting roller extending axially towards the plane of the cutting knife.

6. The device of claim 1, the conveying zone being in a substantially horizontal plane substantially perpendicular to the plane of the cutting knife throughout the length of the conveying zone.

7. A device for cutting through one or several sheets located wholly or partially on top of one another, comprising a frame, a first conveyor mounted on the frame, the first conveyor having an outer surface, a second conveyor mounted on the frame, the second conveyor having an outer surface, a conveying zone being formed between and defined by the outer surfaces of the first and second conveyors for clamping and for conveying the sheets to and through a cutting zone, a cutting roller having a side face and a circumferential surface on which the second conveyor is guided through the cutting zone, a rotating cutting knife having a cutting edge, the cutting edge of the knife being coordinated with a plane parallel to the cutting roller side face, means for rotating the cutting knife, means for driving the first conveyor, means for driving the second conveyor, a pressure roller having circumferential surface and an indentation in the circumferential surface for accommodating the first conveyor, and the pressure roller being aligned with the cutting roller for pressing the first conveyor towards the second conveyor in the cutting zone, the pressure roller extending axially towards the plane of the cutting knife, the pressure roller being movable on bearings, and further including spring means for preloading the pressure roller with an adjustable pressure force to bias the pressure roller towards the cutting roller, the axle bearings of the pressure roller being horizontally adjustable, the pressure roller having elevations and depressions extending in the circumferential direction on the circumferential surface of the pressure roller, and the first conveyor having depressions and elevations in its outer surface extending in the lontitudinal direction of the first conveyor that meet with the elevations and depressions in the pressure roller, the cutting roller having an indentation in its circumferential surface for accommodating the second conveyor, and the cutting roller extending axially towards the plane of the cutting knife, the conveying zone being in a substantially horizontal plane substantially perpendicular to the plane of the cutting knife throughout the length of the conveying zone.

* * * * *